US005888610A

United States Patent [19]

Fournier et al.

[11] Patent Number: 5,888,610

[45] Date of Patent: Mar. 30, 1999

[54] METHOD FOR PRODUCING A PANEL OR THE LIKE WITH STRUCTURAL AND ACOUSTIC PROPERTIES AND PANEL OBTAINED BY SAID METHOD

[75] Inventors: Alain Fournier, Saint Lys; Bruno Pelouze, Castelginest; Pierre Tiefenbach, Plaisance du Touch, all of France

[73] Assignee: Aerospatiale Societe Nationale Industrielle, Paris Cedex, France

[21] Appl. No.: 655,932

[22] Filed: May 31, 1996

[30] Foreign Application Priority Data

Jun. 8, 1995 [FR] France ..... 95 07020

[51] Int. Cl.[6] ..... B32B 3/12

[52] U.S. Cl. ..... 428/116; 156/292; 428/138

[58] Field of Search ..... 428/116, 117, 428/118, 138; 156/292

[56] References Cited

U.S. PATENT DOCUMENTS

| | | | |
|---|---|---|---|
| 3,166,149 | 1/1965 | Hulse et al. | 181/33 |
| 3,439,774 | 4/1969 | Callaway et al. | 428/116 X |
| 4,300,978 | 11/1981 | Whitemore et al. | 156/581 |
| 4,379,191 | 4/1983 | Beggs et al. | 428/118 |
| 4,384,020 | 5/1983 | Beggs et al. | 428/116 X |
| 4,671,841 | 6/1987 | Stephens | 156/292 |
| 4,824,711 | 4/1989 | Cagliostro et al. | 428/116 |
| 4,842,398 | 6/1989 | Ducassou | 428/117 X |
| 4,879,152 | 11/1989 | Green | 428/73 |
| 4,973,506 | 11/1990 | Bauer et al. | 428/73 |
| 4,990,391 | 2/1991 | Veta et al. | 428/116 |
| 5,021,283 | 6/1991 | Takenaka et al. | 428/118 X |
| 5,037,498 | 8/1991 | Umeda | 156/307.3 |
| 5,041,323 | 8/1991 | Rose et al. | 428/116 |

FOREIGN PATENT DOCUMENTS

| | | |
|---|---|---|
| 0201104 | 11/1986 | European Pat. Off. . |
| 0314625 | 5/1989 | European Pat. Off. . |
| 0477505 | 4/1992 | European Pat. Off. . |
| 0543752 | 5/1993 | European Pat. Off. . |
| 2525963 | 11/1983 | France . |
| 2609179 | 7/1988 | France . |
| 2630831 | 11/1989 | France . |
| 2710874 | 4/1995 | France . |
| 3913255 | 10/1990 | Germany . |
| 633604 | 12/1982 | Switzerland . |
| 2056367 | 3/1981 | United Kingdom . |
| WO84/04727 | 12/1984 | WIPO . |
| 8807688 | 10/1988 | WIPO . |
| 9212854 | 8/1992 | WIPO . |

OTHER PUBLICATIONS

Derwent Abstact No. 90–129785, of JP880230074.

French Search Report and Annex.

*Primary Examiner*—Henry F. Epstein
*Attorney, Agent, or Firm*—Young & Thompson

[57] ABSTRACT

A method for producing a sandwich-type panel with structural and acoustic properties and formed of a core with an open cellular structure. The method includes the steps of forming first and second skins by superimposing and hot-pressing at least two fabric plies of mineral or synthetic fibers impregnated with a thermoplastic resin, of forming in one of the skins perforations with a diameter of between about 0.5 and 1.5 mm, with a vacuum proportion of empty spaces on the surface of the skin of between about 10 and 25%, of after preparation of the skins applying on one face of the skins an epoxy adhesive coating, of forming a sandwich including the open cellular structure with the two skins on its opposing faces, and then of hot-pressing the sandwich at an appropriate temperature so as to polymerize the adhesive. During hot-pressing the pressure and duration are set so as to avoid any full or partial obstruction of the perforations of the perforated skin.

34 Claims, 1 Drawing Sheet

METHOD FOR PRODUCING A PANEL OR THE LIKE WITH STRUCTURAL AND ACOUSTIC PROPERTIES AND PANEL OBTAINED BY SAID METHOD

FIELD OF THE INVENTION

The present invention concerns a method for producing a panel or similar element with structural and acoustic properties and more specifically a sandwich type structure formed of a cellular core coated on its two faces and able to resist significant loads and perform acoustic attenuation.

BACKGROUND OF THE INVENTION

Although the following description concerns its application for forming in particular, plane fuselage bulkheads, the invention clearly can be used in any other field where it is necessary or desirable to use slightly lightened sandwich type structures having good mechanical resistance and acoustic properties.

It is known that turboprop aircraft can pose sound insulation problems in the internal cockpit, especially regarding noises and vibrations generated by engines, propellers, aerodynamic noises, etc . . . .

Up until now, the problem of sound insulation has not been satisfactorily resolved, especially regarding the passenger cabin relative to the cargo portion and the specific purpose of the invention is to provide a new type of panel suitable for making bulkheads for passenger cabins.

These bulkheads need to be structural elements, that is, able to bear loads or stresses. The loads or stresses of bulkheads may be extremely significant. In fact, they must contain the luggage in the load bay should the aircraft be forced to make a crash-landing, or resist any abrupt depressurization of the cabin or load bay.

In addition, these bulkheads on the load bay side need to be aesthetic, that is, be decorated so as to match the rest of the cabin.

Currently, there are no panels available satisfying the usual constraints as regards lightness and fire-resistance, but also the above-mentioned various requirements.

The structural panels intended to reduce the effects of a crash-landing do not have any noise-deadening properties.

Moreover, there are sandwich type panels formed of a honeycomb core flanked on one side with a perforated metallic sheet and on the other side with a non-perforated metallic sheet used for their sound-reduction properties, for example as coverings at certain locations of the pod of a turbo-propeller so as to absorb, at least partially, the sound energy of high speed gas flows.

However, these structures have been revealed to lack solidity when it is desired to use them in severe environments for attenuating noise and preserving structural integrity.

U.S. Pat. No. 3,166,149 concerns panels of the type mentioned above but more sophisticated as regards the nature of the composite perforation covering mounted on one of the faces of the honeycomb core. This covering is firstly made of a glass fibre lattice preimpregnated with polymerized resin to stiffen the lattice before being bonded to one of the faces of the honeycomb. A sheet made of a porous material is then bonded to the outer face of the lattice, said sheet being covered with a thin decorative perforated and possibly movable covering, said covering not directly concerned with stiffening the unit. If the panel of U.S. Pat. No. 3,166,149 is considered as being able to be used as bulkheads, its structural rigidity and resistance are nevertheless inadequate to resist significant forces, such as those occurring during a crash-landing.

In addition, the materials generally used to form the honeycomb core and the non-perforated covering, namely an aluminum strip and an aluminum sheet respectively, result in composite structures possessing excessive surface mass.

SUMMARY OF THE INVENTION

The aim of the invention is to offer a new type of panel able to reconcile the strictest requirements concerning lightness, rigidity and mechanical resistance.

To this effect, the invention concerns a method for producing a panel or the like with structural and acoustic properties, said panel being of the sandwich type formed of a core with an open cellular structure covered on its two faces, wherein it consists of:

- forming first and second skins by draping and hot-pressing in suitable temperature and pressure conditions at least two fabric plies of mineral or synthetic fibers impregnated with a thermoplastic resin,
- forming perforations in one of the skins with a diameter of approximately between 0.5 and 1.5 mm and a vacuum proportion on the surface of the skin of between approximately 10 and 25%,
- after preparation, applying an epoxy glue to one of the faces of the skins,
- forming a sandwich including said open honeycomb core with the two skins on its opposing faces, the glue coatings being in contact with the core,
- then hot-pressing the sandwich so as to polymerize the glue in appropriate duration, pressure, and temperature conditions so as to avoid any obstruction, total or partial, of the perforations of the perforated skin.

The two skins are preferably constituted by fabrics of glass fibres impregnated with polyetherimide resin.

The two skins are made of a given number of plies, but preferably said number may be different, this dissymmetrical distribution of the skins on both sides of the central core making it possible to reduce the weight and cost of the panels without impairing its surface evenness owing to the fat of the panel being produced multiphase, that is, the separate consolidation of the elements of the panel before heating the unit. This is why the non-perforated skin may comprise a number of plies (three for example) less than the number (four for example) of the perforated skin, the number of plies being directly linked to the stresses able to be applied to the panel.

According to one preferred embodiment, the epoxy glue coating is applied in the form of a thin film with an extremely small surface mass and the polymerization cycle comprises a rise in temperature in a first stage with a sufficient value and duration to make the glue flow without significantly triggering its polymerization so as to avoid obstructing the perforations of the skin, and then in a second stage with a sufficient value and duration for carrying out said polymerization.

The invention also concerns the panel obtained in accordance with said method, this panel being dimensioned, made to conform and produced with border elements, inserts and other elements for forming aircraft fuselage bulkhead elements. These bulkhead elements possess excellent acoustic attenuation properties for frequencies in excess of 500 Hz and for resisting significant stresses normally applied to the bulkhead. A panel of the invention with a surface area of 1.5 $m^2$ has resisted stresses of about 900 daN.

Furthermore, the perforated face of this bulkhead can be easily treated aesthetically, either by tinting the resin of the skin with a relief surface aspect, such as a granite aspect, obtained on molding, or by thermosheathing a coating, such as a perforated decorative film, or by applying this coating or acoustically transparent textile fiber.

BRIEF DESCRIPTION OF THE DRAWINGS

Other characteristics and advantages shall appear more readily from a reading of the following description, given solely by way of example, of one embodiment of the panel of the invention and with reference to the accompanying drawings of which.

DETAILED DESCRIPTION OF THE INVENTION

Figure 1:
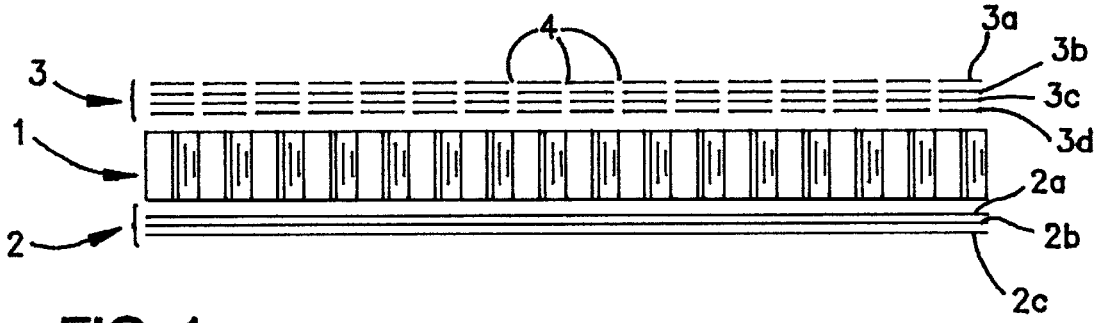
FIG. 1 is a diagrammatic cutaway exploded view of a panel structure according to the invention.

FIG. 1 shows an edge view of the sandwich panel and including a central core with an open cellular structure 1 flanked on both sides with a skin, that is, one multi-ply lower skin 2 and one multi-ply upper skin 3.

In accordance with the invention, each skin 2, 3 is formed of several plies, each ply from a fabric of synthetic or mineral fibers impregnated with a thermoplastic resin and each skin being consolidated prior to assembling of the sandwich. To this effect, a fabric of pre-impregnated fibers is draped along several lays or plies superimposed on a suitable flat surface. The unit is compacted at a suitable temperature according to the nature of the fibers and that of the resin so as to obtain a self-bearing rigid skin. This operation, commonly known as consolidation, is well-known to operators in this field and thus no further details shall be given.

However, it is preferable to use E type glass fibers impregnated with 30 to 35% of polyetherimide resin. The E glass fibers known in the trade under the name "7781" and the polyetherimide rein commercially called "ULTEM" produced by the GENERAL ELECTRIC company are particularly suitable for this application.

One of the skins, namely the upper skin 3, (the terms "upper" and "lower" not having any practical significance as the final sandwich can be used in any spatial position) is in accordance with the invention further provided after consolidation with a plurality of identical hole 4 normally traversing the thickness of the skin.

The proportion on the total surface of the skin 3 of the empty spaces or holes is preferably approximately between 10 and 25% and the diameter of the holes 4 is between about 0.5 and 1.5 mm, and more particularly 1 mm more for a percentage of empty spaces of about 23%. It is also preferable that the diameter of the holes is larger than or equal to the thickness of the skin.

Furthermore, the distribution of the holes is uniform over the entire surface.

The skins 2 and 3 are preferably formed from the same fibers and resin and, according to another characteristic of the invention, comprise a different number of plies, that of the perforated skin 3 being larger than that of the non-perforated skin 2.

By way of example, the non-perforated skin 2 comprises three plies: 2*a*, 2*b*, 2*c* and the perforated skin 3 has four: 3*a*, 3*b*, 3*c*, 3*d*.

Once the skins 2, 3 have been consolidated, they are then glued to the core 1. This is generally speaking a structure with open cells along an axis perpendicular to the median plane of the core and in particular is formed of a honeycomb structure made of aramid fiber paper, such as the one commercially known as "NOMEX".

One of the faces of each skin 2, 3 is coated with a suitable epoxy glue applied as uniformly as possible. For example, the glue could be applied by spraying, but preferably shall be constituted by a thin film with an extremely small surface mass of about 70 g/m$^2$, for example. The adhesive film called SCOTCH-WELD® AF 163-2U produced by the 3M company is perfectly suitable. It is to be noted that this adhesive is self-extinguishable with respect to fire and it is preferable to use a glue having this characteristic.

The portions 1, 2, 3 of the sandwich are then superimposed on a hot pressing plate and subjected to a baking cycle so as to polymerize the glue.

In accordance with the invention and when using a 3M adhesive film, the polymerization cycle is carried out at constant pressure of about 1 bar or slightly more and by bringing the temperature in a first age 5 to about 80° C. and then in a second stage 6 to about 130° C. before lowering the temperature to about 50° C. at which the pressure is removed and the panel removed from the mold.

Figure 3:
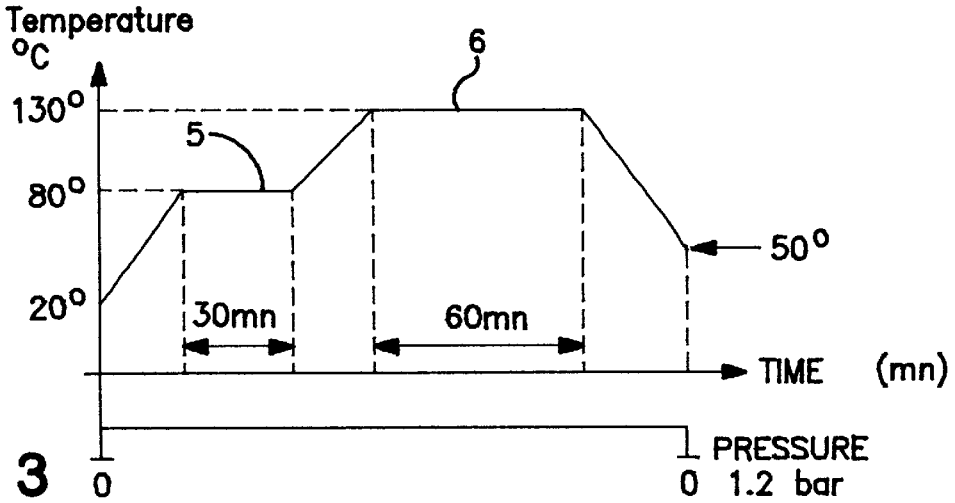
FIG. 3 is a curve illustrating a preferred baking cycle of the panel.

FIG. 3 illustrates a cycle of the type mentioned above during which the temperature stage 5 at 80° C. is maintained for 30 minutes and the stage 6 at 130° C. for 60 minutes, a pressure of 1.2 bar being maintained throughout the cycle.

The temperature of the first stage 5 and the period of the latter are determined so as to make the glue yield, i.e., flow, without significantly initiating the polymerization phase.

During this first stage 5, the glue shall be liquefied and at the level of the holes of the perforated skin the film shall break and the material of the glue shall bind by forming a meniscus at the skin 3/core 1 interface and on the circumference of each hole 4.

As for the second temperature stage 6, this is carried out at a satisfactory temperature and for a suitable period to achieve total polymerization.

In the case of applying the glue by spraying, the holes 4 shall not be obstructed and the polymerization cycle is carried out normally and does not comprise the two temperature stage of FIG. 3.

Figure 2:
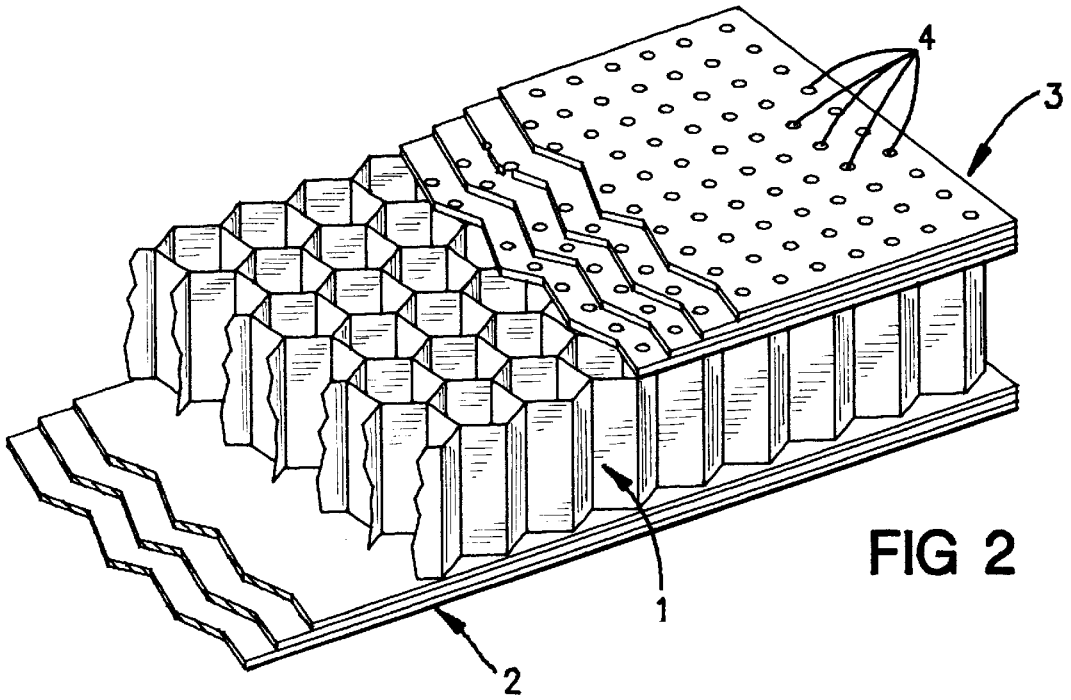
FIG. 2 is a partial perspective pulled away view of a panel embodied of the type shown in FIG. 1.

FIG. 2 illustrates a panel formed according to the stacking diagram of FIG. 1.

In practice, the panel shall be embodied directly with the shapes and dimensions of the bulkhead or bulkhead element to be obtained, for example, so as to separate the load bay and passenger zones of a turboprop aircraft.

To this effect, after the skins have been consolidated, the number of plies of each skin being determined according to the nature and location of the bulkhead to be embodied, the skins shall be trimmed with a laser and then subsequently be followed by a folding and burring. Similarly, the honeycomb shall be machined, burred and trimmed.

The faces of the skins to be glued shall be smoothened, dedusted, degreased and coated with a suitable epoxy adhesive film.

The three elements making up the sandwich shall then be placed in a mold and completed by bordering and reinforcement elements, inserts, etc.

The mold shall then finally be placed between the plates of a heating press so as to undergo said glue or adhesive polymerization cycle.

The panels, bulkhead or bulkhead elements obtained can be flat or curved or have flat portions forming an angle between one another.

By way of example, the method of the invention is able to obtain consolidated skins ready for mounting as a multi-ply, each ply having a thickness of 0.25 mm and a surface mass of 450 g/m$^2$ for a non-perforated ply and 350 g/m$^2$ for a perforated play, the fabric of fibers being constituted by E glass, with a surface mass of 300 g/m$^2$, a thickness of 20/100 of a millimeter, a satin-weave 8 with a number of chain threads of 22 and weft threads of 20, the resin being a polyetherimide.

In accordance with the invention, the consolidation of the skins prior to assembling makes it possible to form dissymmetrical panels having one reinforced face with a number of plies exceeding that of the other face.

If the conventional technique were used to perform the co-baking of this sandwich panel, it would be necessary to have the same amount of plies on each side of the honeycomb so as to avoid any deformation of buckling of the panel during polymerization. This deformation or buckling would make placing an additional ply on one of the faces pointless.

The technique of the invention can eliminate a ply on the less stressed face, which lowers the weight of the unit and reduces costs. In addition, the surfaces of the sandwich panel remain perfectly flat despite the dissymmetrical distribution of the skins.

Generally speaking, the thickness of the core 1 is directly linked to the spectrum of frequency it is desired to attenuate. For the frequencies mentioned in applications relating to bulkheads of turboprop aircraft, that is, frequencies within the range of 1200 to 2000 Hz, the thickness of the core 1 shall typically be about twenty millimeters.

As for the diameter of the holes 4, this is strictly linked to the vacuum percentage in the perforated skin, it being understood moreover that the pairing of these two parameters (diameter of holes and vacuum percentage) could evolve according to the acoustic characteristics or properties of any possible decorative coating elements provided on the perforated skin.

In fact, apart from the structural, acoustic attenuation and lightness properties of the panels or bulkheads obtained in accordance with the invention, the easy and inexpensive decoration of the bulkheads is also notable. The decorated may be added either by using a bulk tinted resin for the skins, or by the mold on which the plies are draped, said mold providing on the visible face of the skin an aesthetic surface state, such as a granite aspect, or even coating the perforated skin, by thermosheathing a perforated decorative film or gluing said film or an acoustically transparent textile coating.

Finally, the panels, bulkheads or other products obtained in accordance with the method of the invention shall satisfy the standard FAR § 853 (Fire/Fumes/Toxicity criteria) applicable to commercial aircraft, especially owing to the choice of a polytherimide resin for the skins.

What is claimed is:

1. A method for producing an acoustic sandwich panel, comprising:

forming first and second skins by superimposing and hot-pressing at least two fabric plies of mineral or synthetic fibers impregnated with a thermoplastic resin;

perforating one of the skins to form perforations having a diameter of approximately between 0.5 and 1.5 mm with a vacuum proportion of empty spaces on a surface of the skin of between approximately 10 and 25%;

after the forming of the skins and perforating one of the skins, applying an epoxy adhesive to one face of each skin by spraying in a manner not to obstruct the holes of said perforated skin;

forming a sandwich including an open cellular core having two opposing faces with the two skins on the opposing faces of the core, the adhesive being in contact with the core; and hot-pressing the sandwich to polymerize the adhesive, wherein pressure and temperature are such that partial and total obstructions of the perforations of the perforated skin are avoided.

2. The method of claim 1, wherein the skins comprise glass fibers impregnated with polyetherimide resin.

3. The method of claim 1, wherein the two skins comprise a different number of plies.

4. The method of claim 1, wherein the adhesive comprises a thin film having an extremely small surface mass.

5. A sandwich panel obtained by the method of claim 1.

6. The sandwich panel of claim 5, wherein the cellular core is a honeycomb core.

7. The sandwich panel of claim 5, wherein the perforated skin comprises four plies and the other skin is a non-perforated skin comprising three plies.

8. The sandwich panel of claim 7, wherein each of the plies has a thickness of 0.25 mm, and wherein each of the plies comprises E glass fibers impregnated with polyetherimide resin.

9. The sandwich panel of claim 5, wherein the perforated skin includes perforations with a diameter of about 1 mm, and wherein the vacuum proportion of empty spaces in the perforated skin is about 23%.

10. The sandwich panel of claim 5, wherein the thermoplastic resin of at least one of the skins is bulk tinted.

11. The sandwich panel of claim 5, wherein a visible face of at least one of the skins is coated by thermosheathing a decorated film.

12. The sandwich panel of claim 11, wherein the decorated film is perforated.

13. The sandwich panel of claim 5, wherein a visible face of at least one of the skins is coated with a textile fiber.

14. The sandwich panel of claim 13, wherein the textile fiber is acoustically transparent.

15. The sandwich panel of claim 5, wherein a visible face of at least one of the skins has a relief surface aspect.

16. The sandwich panel of claim 15, wherein the relief surface aspect comprises a granulated aspect.

17. A method for producing an acoustic sandwich panel, comprising:

forming first and second skins by superimposing and hot-pressing at least two fabric plies of mineral or synthetic fibers impregnated with a thermoplastic resin;

perforating one of the skins to form perforations having a diameter of approximately between 0.5 mm and 1.5 mm with a vacuum proportion of empty spaces on a surface of the skin of between approximately 10 and 25%;

after the forming of the skins and perforating of one of the skins, applying an epoxy resin comprising a thin film having an extremely small surface mass;

forming a sandwich including an open cellular core having two opposing faces of the core, the adhesive being in contact with the core; and hot-pressing the sandwich to polymerize the adhesive, said hot-pressing involving a cycle including a rise in temperature to a first stage having sufficient temperature and duration such that the adhesive flows without significantly triggering polymerization, and then a second stage involving a sufficient temperature and duration so as to polymerize the adhesive, and wherein the temperature in the second stage is higher than the temperature in the first stage.

18. The method of claim 17, wherein the adhesive is a self-extinguishing adhesive.

19. The method of claim 17, wherein the duration of the first stage is about 30 minutes and the duration of the second stage is about 60 minutes.

20. The method of claim 17, wherein the cellular core comprises a honeycomb core.

21. The method of claim 17, wherein the skins comprise glass fibers impregnated with polyetherimide resin.

22. The method of claim 17, wherein the two skins comprise a different number of plies.

23. A sandwich panel obtained by the method of claim 17.

24. The sandwich panel of claim 23, wherein the cellular core is a honeycomb core.

25. The sandwich panel of claim 23, wherein the perforated skin comprises four plies and the other skin is a non-perforated skin comprising three plies.

26. The sandwich panel of claim 23, wherein each of the plies has a thickness of 0.25 mm, and wherein each of the plies comprises E glass fibers impregnated with polyetherimide resin.

27. The sandwich panel of claim 23, wherein the perforated skin includes perforations with a diameter of about 1 mm, and wherein the vacuum proportion of empty spaces in the perforated skin is about 23%.

28. The sandwich panel of claim 23, wherein the thermoplastic resin of at least one of the skins is bulk tinted.

29. The sandwich panel of claim 23, wherein a visible face of at least one of the skins is coated by thermosheathing a decorated film.

30. The sandwich panel of claim 29, wherein the decorated film is perforated.

31. The sandwich panel of claim 23, wherein a visible face of at least one of the skins is coated with a textile fiber.

32. The sandwich panel of claim 31, wherein the textile fiber is acoustically transparent.

33. The sandwich panel of claim 23, wherein a visible face of at least one of the skins has a relief surface aspect.

34. The sandwich panel of claim 33, wherein the relief surface aspect comprises a granulated aspect.

* * * * *